US006415994B1

(12) United States Patent
Boggs

(10) Patent No.: US 6,415,994 B1
(45) Date of Patent: Jul. 9, 2002

(54) ROTATIONAL NOZZLE ATOMIZER

(76) Inventor: Clayton F Boggs, 380 Country Rd. 558, Rogersville, AL (US) 35652

( * ) Notice: Subject to any disclaimer, the term of this patent is extended or adjusted under 35 U.S.C. 154(b) by 0 days.

(21) Appl. No.: 09/650,232

(22) Filed: Aug. 29, 2000

(51) Int. Cl.[7] ..... B05B 1/34
(52) U.S. Cl. ..... 239/463; 239/533.15
(58) Field of Search ..... 239/461, 463, 239/464, 533.15, 533.1

(56) References Cited

U.S. PATENT DOCUMENTS 602,074 A * 4/1898 Gumtow
2,643,915 A * 6/1953 Pieroni
2,981,483 A * 4/1961 Pichon
3,147,924 A * 9/1964 Schulze

* cited by examiner

*Primary Examiner*—Lesley D. Morris
(74) *Attorney, Agent, or Firm*—Michael I. Kroll

(57) ABSTRACT

The present invention discloses an atomizer 28 facing the component 32, 34, 36, 64 to be cooled and sprayed. The atomizer 28 has a first housing 90 and a second housing 92 joined together by threads 103, 108. Fluid passes from the inlet 76 to the outlet 70 through a central conduit 80 and a spring 82 and ball 84 check valve assembly is used to control the fluid flow. The atomized spray 30 takes on a spiraling nature due to the presence of a rotational nozzle 86 within the atomizer 28 that is acted upon by the passage of the pressurized fluid traveling through multiple diagonal channels 94 cut in the nozzle's head 78.

15 Claims, 12 Drawing Sheets

ROTATIONAL NOZZLE ATOMIZER

BACKGROUND OF THE INVENTION

1. Field of the Invention

The present invention relates generally to spray nozzles and, more particularly, is directed to a rotational spray nozzle which emits fluid in a rotational spray pattern. The rotational nozzle may be used in conjunction with an automotive cooling system, or an automatic emergency cooling and refilling system which detects when the temperature in a vehicle's cooling system rises above a selected level and automatically activates an atomized spray over the face of the radiator to prevent the engine from overheating thereby allowing an operator to continue driving uninterrupted to a desirable location.

2. Description of the Prior Art

Spray nozzles have been described in the prior art. While these spray nozzles may be suitable for the purposes for which they were designed, they would not be as suitable for the purposes of the present invention as heretofore described. It is thus desirable to provide a rotational nozzle atomizer that can be adapted to fit any application involving a heat exchanger, such as an automobile radiator and transmission cooler/air conditioner condenser coil or residential and commercial central air condenser coils. The present invention can be factory installed or retrofit to existing units and may be automatically activated when a thermocouple detects a high temperature condition and activates a pump that moves fluid from an independent reservoir to atomizers facing the component to be cooled and sprayed thereupon. The atomized spray takes on a spiraling nature due to the presence of a rotational nozzle within the atomizer that is acted upon by the passage of the pressurized fluid traveling through diagonal channels cut in the nozzle's head.

SUMMARY OF THE PRESENT INVENTION

The present invention discloses a rotational atomizer for spraying fluid onto a surface which is to be cooled by the fluid. A conduit is disclosed containing a plurality of atomizers strategically placed to provide a means of egress for the pressurized fluid during atomization and the resulting spray is ejected upon the object to be cooled such as a radiator or condensing coil. The emission from the atomizer takes on a rotational effect due to the properties of a free-spinning rotational nozzle within the atomizer. The atomizer has a threaded two-piece housing with a central recess and inlet conduit extending longitudinally therethrough and said inlet conduit leads to a fluid inlet recess situated within the interior portion of the conduit and an egress recess on a distal end of the atomizer and in an exterior region of the conduit facing the component to be cooled thereby providing a passageway through which fluid can travel. The central recess houses the atomization components comprising a spring loaded ball-type check valve and an atomizing rotational nozzle having a cylindrical nozzle head and a shank being of sufficient diameter to nestle inside the spring without restricting the potential for the axial rotation of the nozzle. When the atomizer is assembled the nozzle head is placed against the egress recess of the housing with the shank residing within a first end of the spring and the ball of the check valve held in place against the inlet conduit by a second end of said spring. The spring exerts an opposing bias to the nozzle and to the check ball. Fluid enters the atomizer through the inlet recess, passes through the inlet conduit where the flow into the central recess is restricted by the ball of the check valve which is of a greater diameter than the inlet conduit until the pressure within the conduit is greater than the bias presented by the spring resulting in the ball moving away from the inlet recess and compressing the spring thereby increasing the bias applied to the nozzle against the egress portion of the housing. Diagonally cut channels extend from the upper side portion of the nozzle head to the top thereof providing the only path for the pressurized fluid to travel from the central recess to the egress recess. The pressure of the fluid passing through the channels causes the propeller-like axial rotation of the nozzle head resulting in a spiraling, atomized spray.

An object of the present invention is to provide a rotational atomizer which may be used with an emergency cooling and refilling system having a plurality of atomizers.

A further object of the present invention is to provide an atomizer having an internal rotational nozzle and a spring loaded check valve with said spring exerting an opposing bias to the nozzle and the check ball.

A still further object of the present invention is to provide a nozzle head having a plurality of diagonal channels cut into the upper portion thereof providing a passage for pressurized fluid flow from the side of the nozzle head to the top resulting in atomization of the fluid and the axial rotation of the nozzle as the fluid passes therethrough providing greater force in the ejection of the atomized spray Additional objects of the present invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views.

LIST OF REFERENCE NUMERALS

Figure 1:
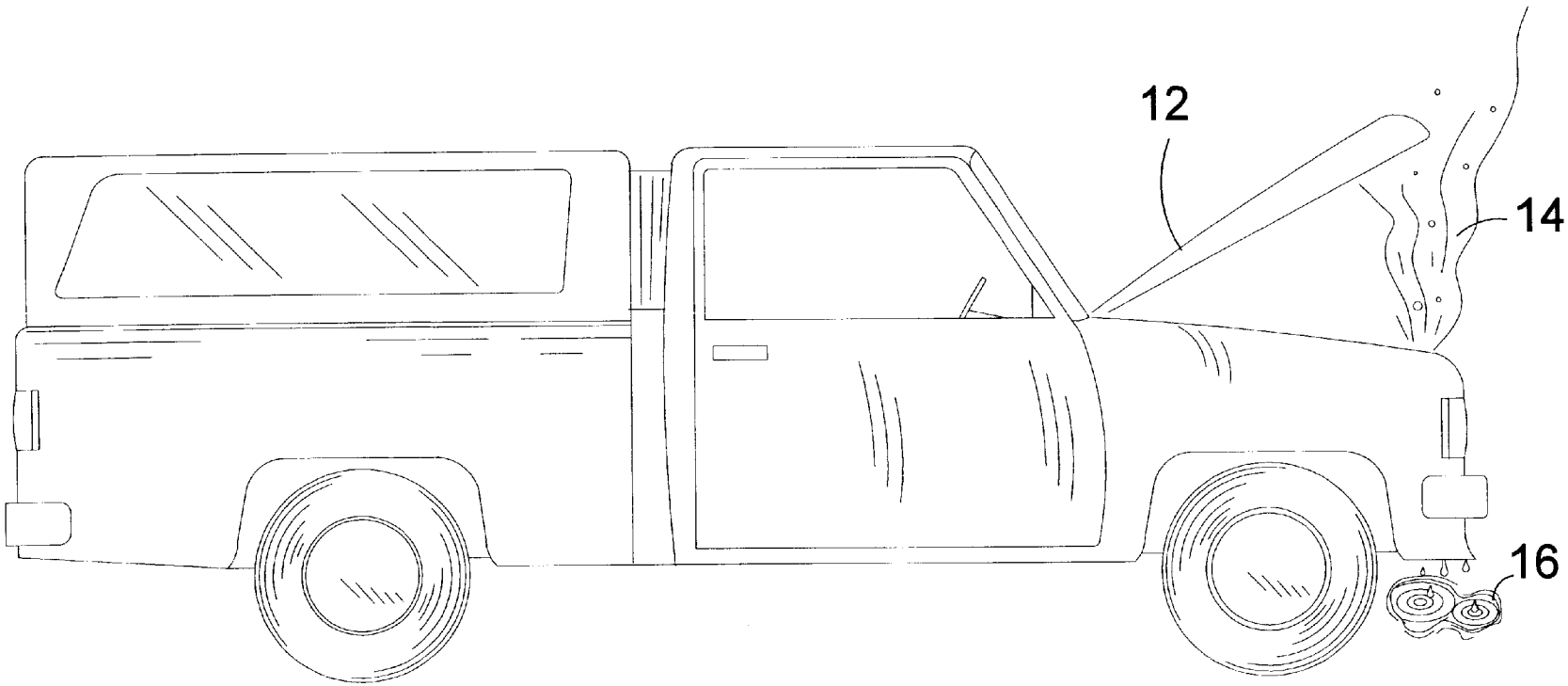
FIG 1 (PRIOR ART)
FIG. 1 is side view of the prior art showing a truck that has overheated and rendered disabled.

With regard to reference numerals used, the following numbering is used throughout the drawings.

10 present invention
12 vehicle
14 steam
16 fluid/coolant
18 direction arrow
20 thermocouple
22 reservoir
24 pump
26 conduit
28 atomizer
30 spray
32 first radiator
34 air conditioner condenser coil
36 transmission cooler
38 direction arrow
40 conduit
42 3-way valve
44 emergency refill conduit
46 check valve
48 solenoid
50 thermostat
52 second radiator
54 fill sensor
56 3-position switch
58 manual
60 automatic
62 refill
64 central A/C coil
66 local water supply
68 direction arrow
70 outlet aperture
74 filtration screen
76 inlet aperture
78 nozzle head
80 central recess
82 spring
84 ball
86 nozzle
88 nozzle shank
90 first housing
92 second housing
94 channels
96 first end
98 second end
100 first end
102 second end
103 internal threads
104 external threads
106 head
108 external threads
110 head

DESCRIPTION OF THE PREFERRED EMBODIMENT(S)

In order that the invention may be more fully understood, it will now by described, by way of example, with reference to the accompanying drawings in which FIGS. 1 through 12 illustrate the present invention being an emergency cooling and refilling system.

Turning to FIG. 1, shown therein is side view of the prior art showing a truck vehicle 12 that has overheated and rendered disabled. Shown is steam 14 and coolant fluid 16 from the truck vehicle 12. The present invention discloses a cooling system for vehicles 12 and, more specifically, an emergency cooling and refilling system for motor vehicles 12, air conditioning systems and other heat exchanger applications.

Figure 2:
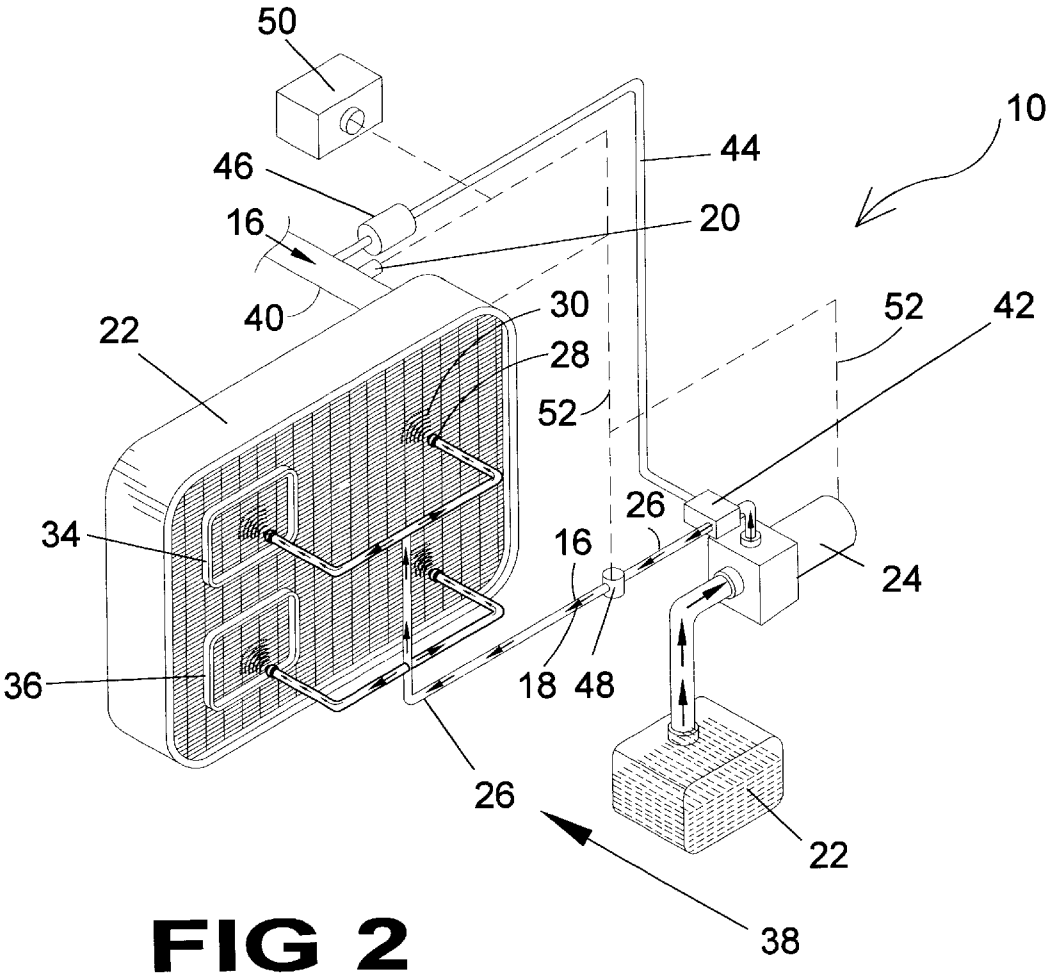
FIG. 2 is a perspective diagrammatic view showing the components of the present invention and the flow of fluid therein during operation.

Turning to FIG. 2, shown therein is a perspective diagrammatic view showing the components of the present invention 10 and the flow of fluid 16 shown by direction arrows 18 therein during operation. The present invention 10 discloses a cooling system for vehicles and, more specifically, an emergency cooling and refilling system for motor vehicles, air conditioning systems and other heat exchanger applications wherein the system is automatically initiated when a high temperature condition is detected by a thermocouple 20 communicating with the cooling system of the apparatus being maintained. Fluid 16 is then transferred from an independent reservoir 22 through a pump 24 and into a conduit 26 where it is pressurized. The conduit 26 contains a plurality of atomizers 28 strategically placed to provide a spray 30 of fluid 16 which is ejected onto the object to be cooled such as a radiator 32, air conditioning condenser coil 34 or transmission cooler 36. Also shown is a direction arrow 38 indicating the direction of air flow toward the radiation 32. Also shown is the coolant conduit 40 carrying cooling fluid 16 from the engine to the radiator. A 3-way electrically operated valve 42 is shown connected by an emergency refill conduit 44 to conduit 40 having a check valve 46 therein. A solenoid valve 48 is shown in conduit 18 being electrically connected 52 to thermocouple 20, thermostat 50 and pump 24.

Figure 3:
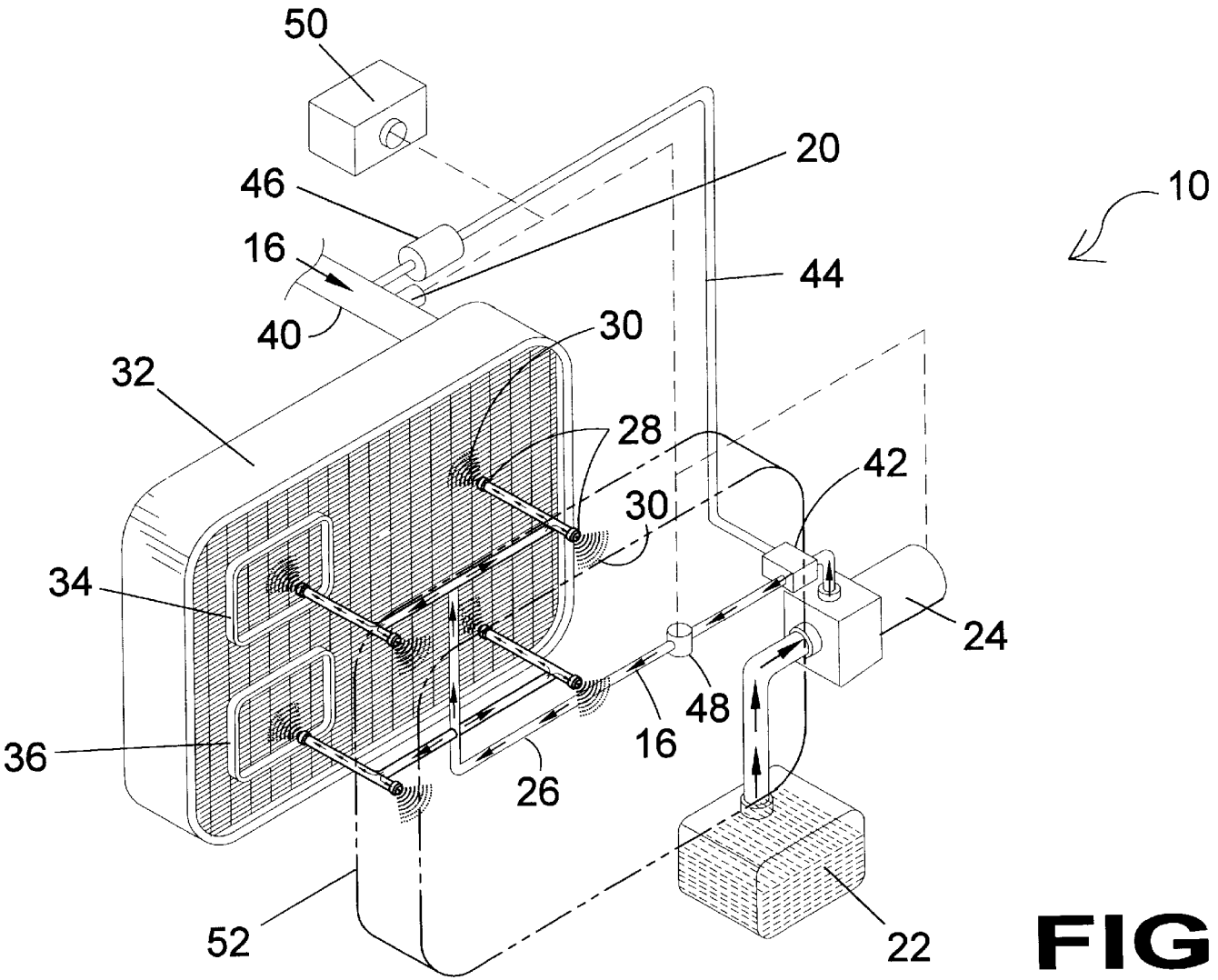
FIG. 3 is a perspective diagrammatic view showing the components of the present invention and the flow of fluid therein with a cooling system using a dual radiator configuration.

Turning to FIG. 3, shown therein is a perspective diagrammatic view showing the components of the present invention 10 and the flow of fluid 16 therein with a cooling system using a dual radiator configuration. The elements of this embodiment are similar to those previously disclosed. In this embodiment the atomization conduit terminates into multiple, e.g., eight, atomizers 28 positioned to provide spray 30 onto the pair of radiators 32, 52.

Figure 4:
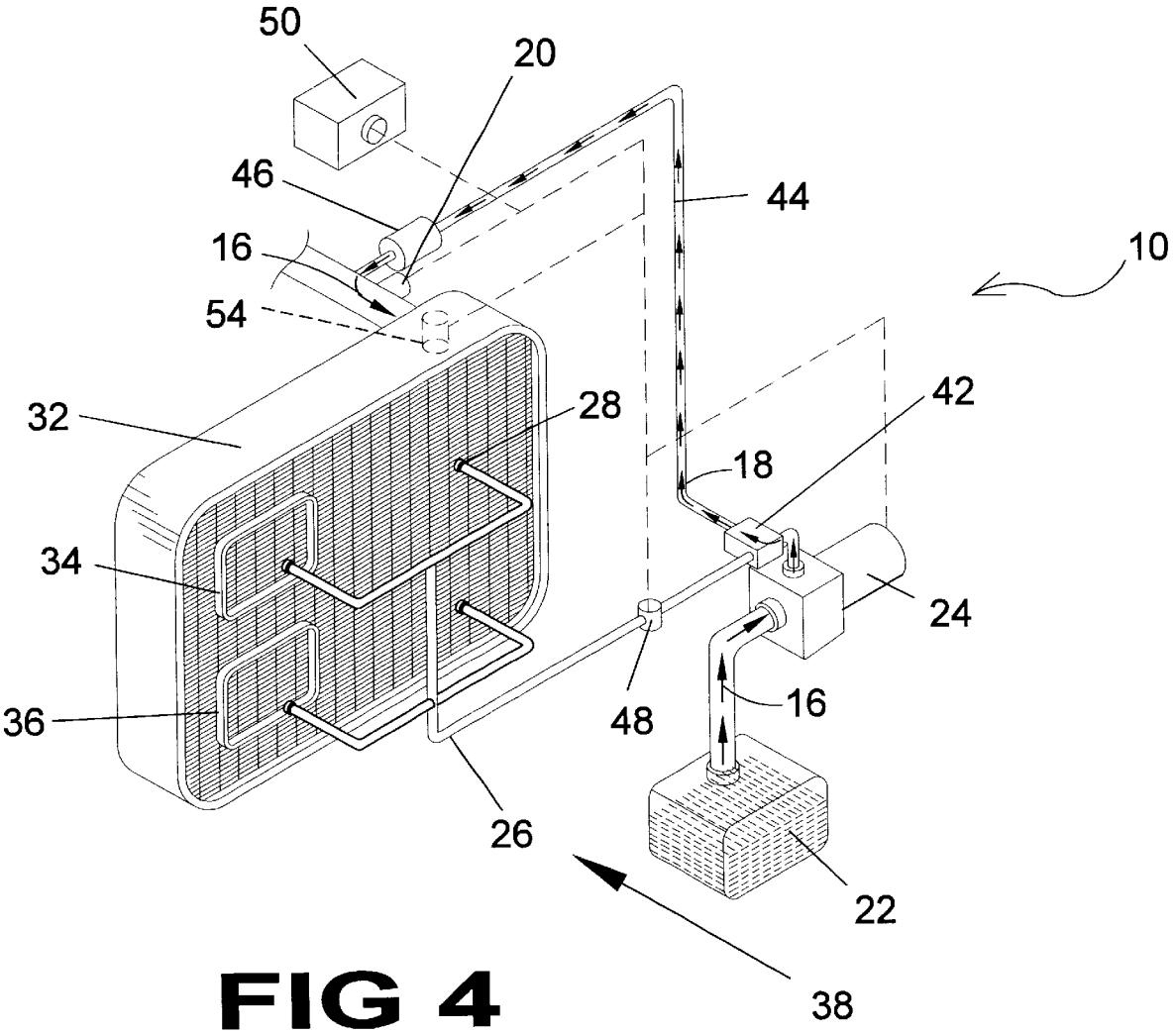
FIG. 4 is a perspective diagrammatic view showing the components of the present invention and the flow of fluid therein during refilling of the radiator.

Turning to FIG. 4, shown therein is a perspective diagrammatic view showing the components of the present invention 10 and the flow of fluid 16 therein during refilling of the radiator 32. The elements of this embodiment are similar to those previously disclosed. The present invention 10 also provides a means for a vehicle operator to replace radiator fluid with fluid 16 from the independent reservoir 22 simply by activating a switch (not shown, but see FIG. 5) in an accessible panel that monitors and controls operation of the emergency system. Fluid 16 flow is redirected by a 3-way valve 42 to refill the radiation as indicated by arrow 18. A fill sensor 54 located within the radiator 32 will detect when the desired amount of fluid 16 has been introduced to the cooling system and will automatically discontinue operation.

Figure 5:
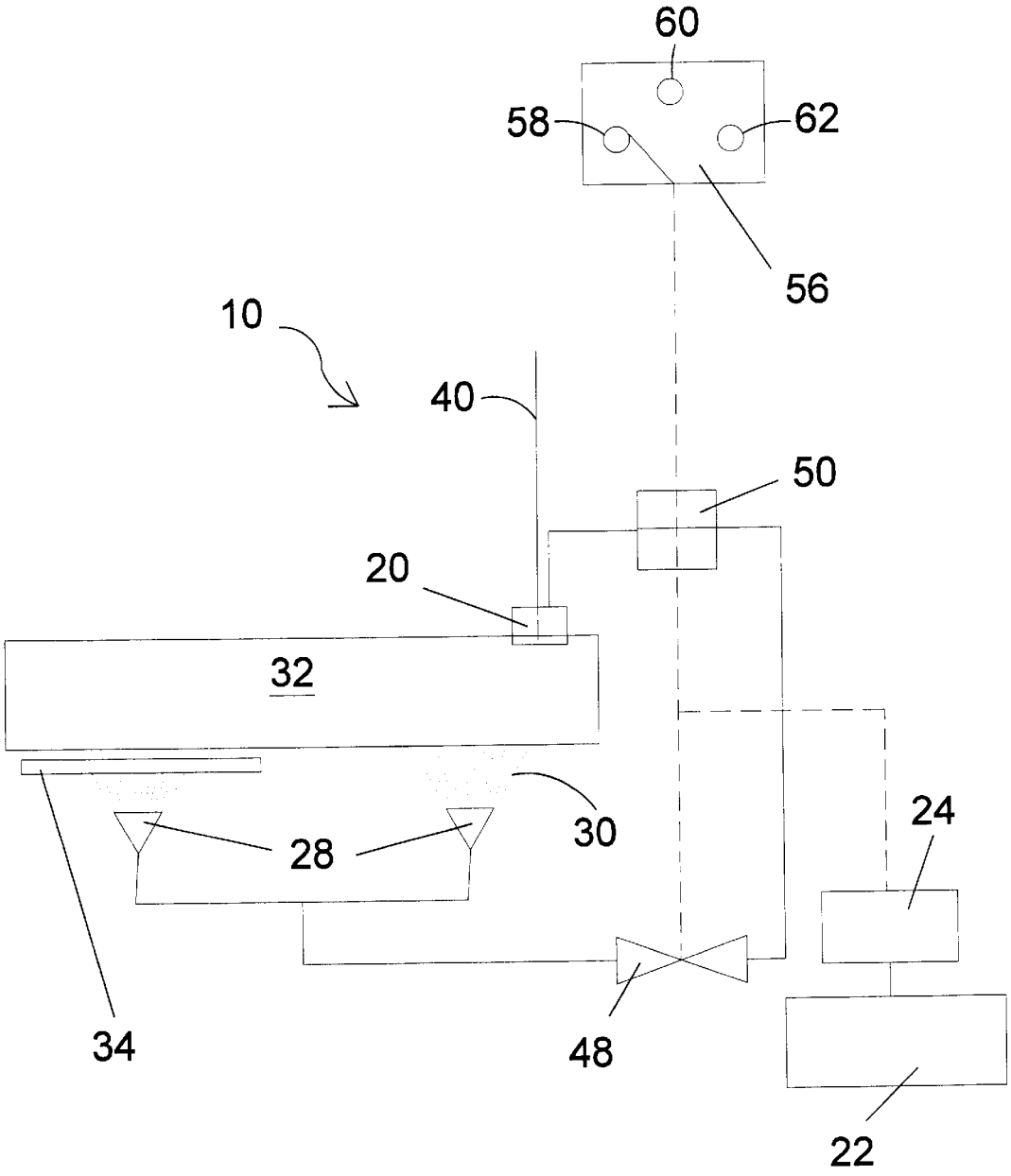
FIG. 5 is a block diagram depicting the interaction and relationship of the various components of the present invention as applied to a vehicle.

Turning to FIG. 5, shown therein is a block diagram depicting the interaction and relationship of the various components of the present invention 10 as applied to a vehicle. Also shown is a 3-position switch 56 having a manual 58, automatic 60, and a refill 62 position.

Figure 6:
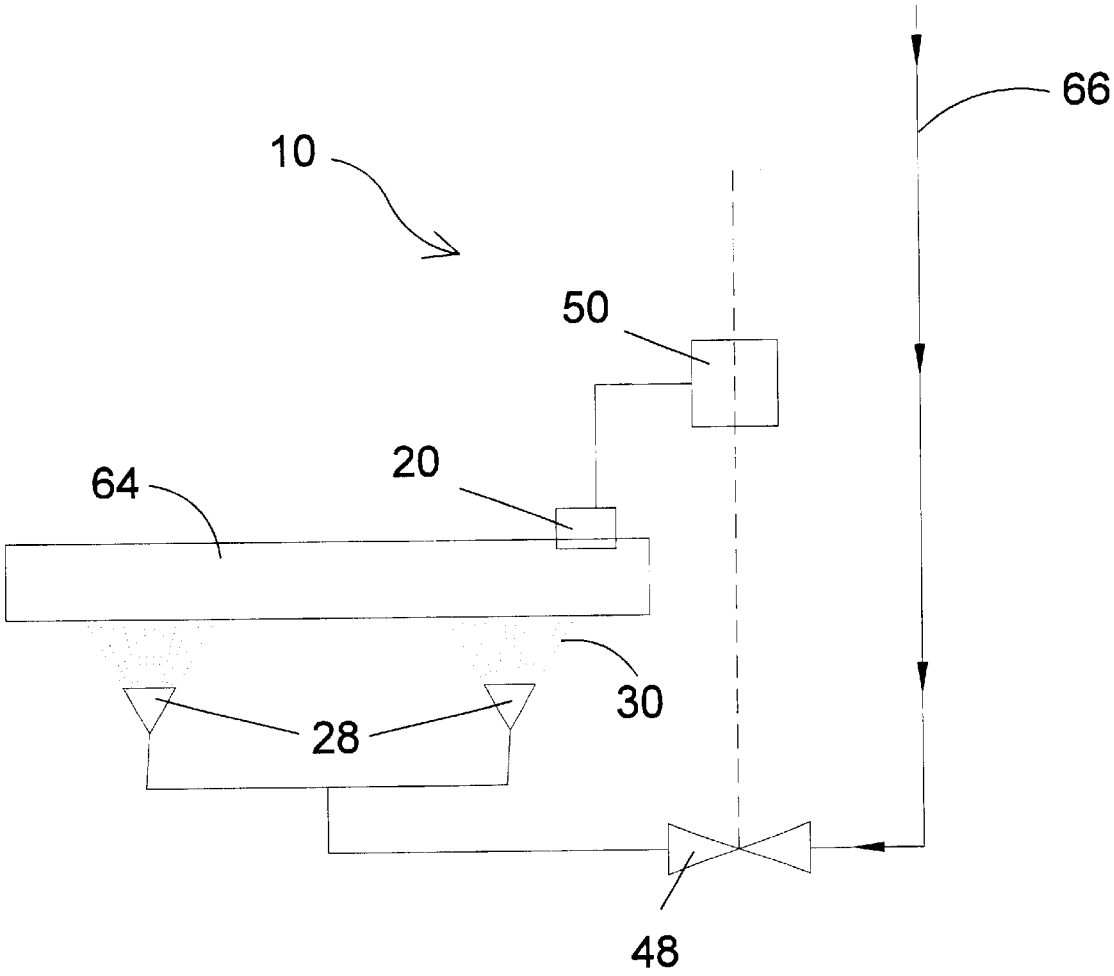
FIG. 6 is a block diagram depicting the interaction and relationship of the various components of the present invention as applied to a central air conditioning unit.

Turning to FIG. 6, shown therein is a block diagram depicting the interaction and relationship of the various components of the present invention 10 as applied to a central air conditioning unit 64 or air condensing coil. Elements previously disclosed are shown along with a local water supply 66 which serves as the source of the cooling fluid spray 30.

Figure 7:
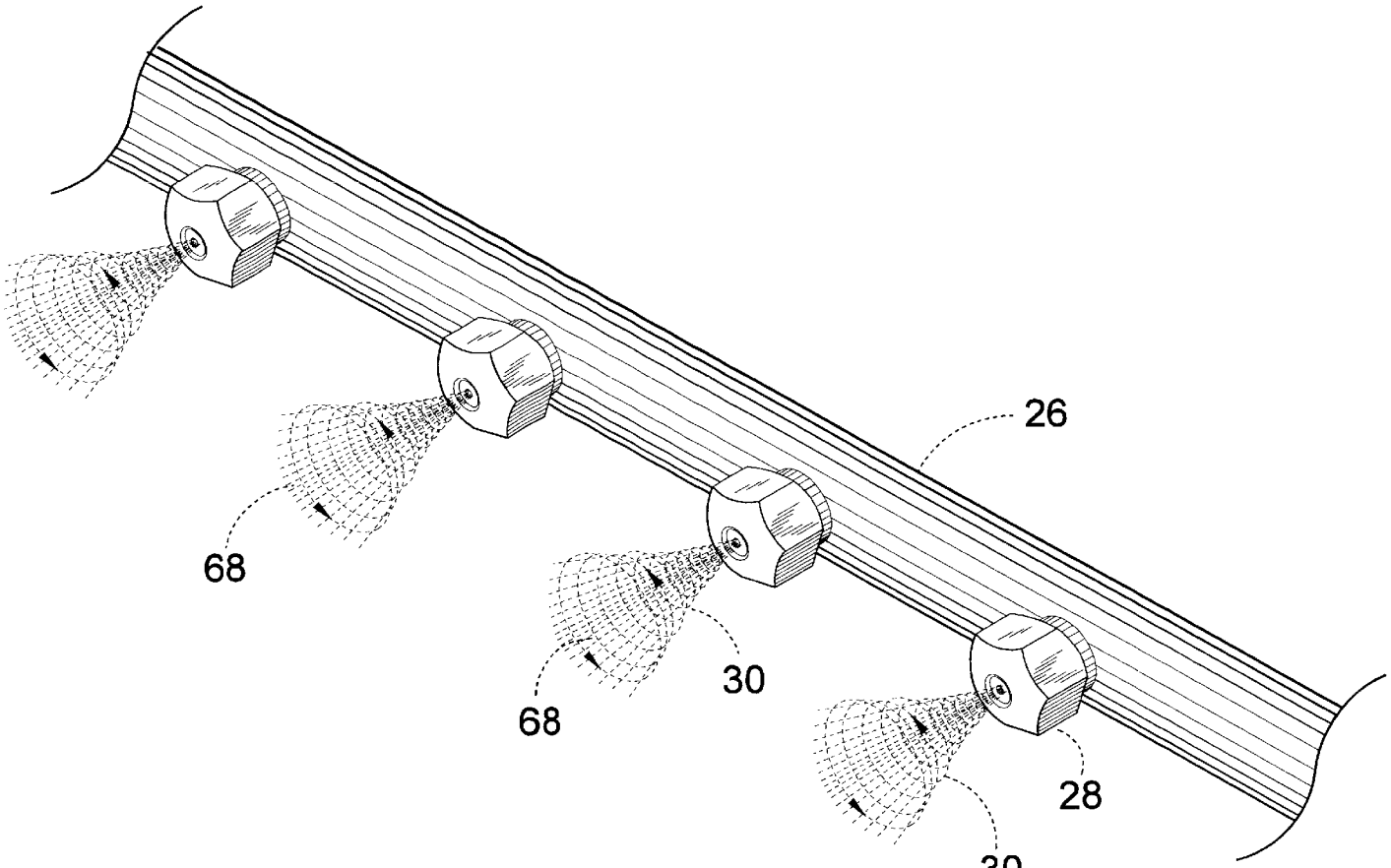
FIG. 7 is a perspective view showing a plurality of atomizers installed in series and activated.

Turning to FIG. 7, shown therein is a perspective view showing a plurality of atomizers 28 installed in series in a conduit 26 and activated. Direction arrows 68 indicate the rotation direction of atomized spray 30 caused by the unique design of the atomizers 28.

Figure 8:
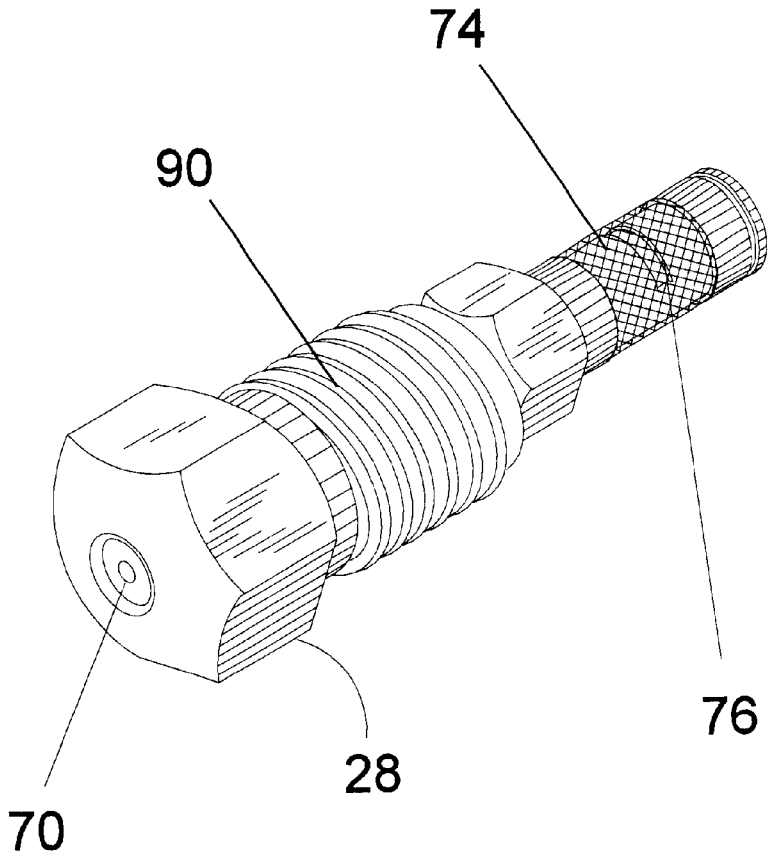
FIG. 8 is a perspective view of an atomizer.

Turning to FIG. 8, shown therein is a perspective view of an atomizer 28. Shown is the fluid egress recess or outlet aperture 70 along with the housing 90, filtration screen 74 and inlet recess or aperture 76.

Figure 9:
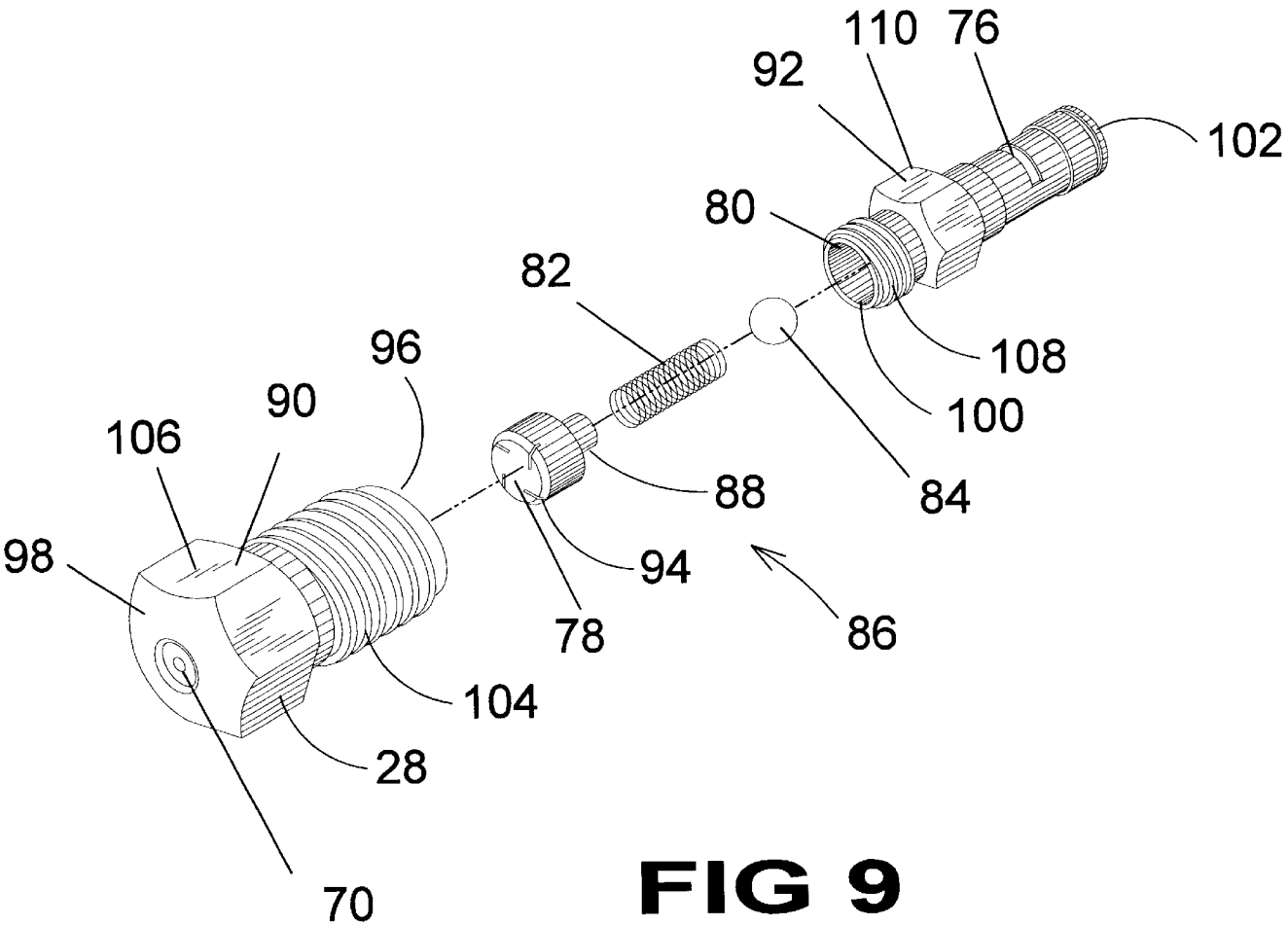
FIG. 9 is an exploded perspective view of an atomizer with a rotational nozzle and check valve assembly.

Turning to FIG. 9, shown therein is an exploded perspective view of an atomizer 28 having a rotational nozzle head 78 and check valve assembly. As previously disclosed, the fluid conduit contains a plurality of atomizers 28 strategically placed to provide a means of egress for the pressurized fluid during atomization and the resulting spray is ejected upon the object to be cooled such as a radiator or condensing coil. The emission from the atomizer 28 takes on a rotational effect due to the properties of a free-spinning rotational nozzle head 78 within the atomizer. The atomizer has a threaded two-piece, first 90 and second 92 housing with a central conduit 80 extending longitudinally therethrough wherein the inlet aperture 76 is located toward one end of the housing 92 and an egress recess 70 is located on a distal end of the atomizer housing 90 and in an exterior region of the conduit facing the component to be cooled thereby providing a passageway through which fluid can travel. First housing 90 has a first end 96 and a second end 98. Second housing 92 has a first end 100 and a second end 102. Housing 90 also has internal threads 103 (not shown, but see FIG. 12) and external threads 104 and a head portion 106 for receiving a wrench for tightening. Housing 92 also has external threads 108 and a head portion 110 for receiving a wrench for tightening The central recess 80 houses the atomization components comprising a spring 82 loaded ball-type 84 check valve assembly and an atomizing rotational nozzle 86 having a cylindrical nozzle head 78 and a shank 88 being of sufficient diameter to nestle inside the spring 82 without restricting the potential for the axial rotation of the nozzle head 78. When the atomizer is assembled the nozzle head 78 is placed against the egress recess of the housing 90 with the shank 88 residing within a first end of the spring 82 and the ball 84 of the check valve held in place against the inlet conduit by a second end of the spring 82. The spring 82 exerts an opposing bias to the nozzle 86 and to the check ball 84. Fluid enters the atomizer through the inlet recess 76, passes through the inlet conduit where the flow into the central recess 80 is restricted by the ball 84 of the check valve which is of a greater diameter than the inlet conduit until the pressure within the conduit is greater than the bias presented by the spring 82 resulting in the ball 84 moving away from the inlet recess and compressing the spring 82 thereby increasing the bias applied to the nozzle 86 against the egress portion of the housing 90. Diagonally cut multiple channels 94 extend from the upper side portion of the nozzle head 78 to the top thereof providing the only path for the pressurized fluid to travel from the central recess to the egress recess. The pressure of the fluid passing through the channels 94 causes the propeller-like axial rotation of the nozzle head 78 resulting in a spiraling, atomized spray.

Figure 10:
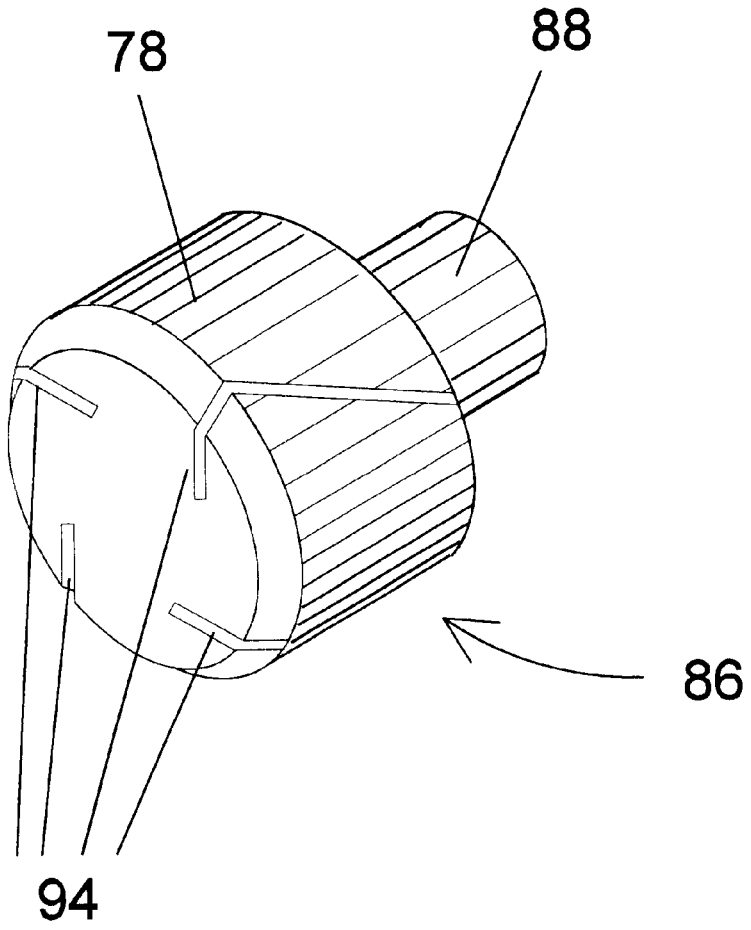
FIG. 10 is a perspective view of the rotational nozzle of the atomizer.

Turning to FIG. 10, shown therein is a perspective view of the rotational nozzle 86 of the atomizer. Diagonally cut multiple channels 94 extend from the upper side portion of the nozzle head 78 to the top thereof providing the only path for the pressurized fluid to travel from the central recess to the egress recess. The pressure of the fluid passing through the channels 94 causes the propeller-like axial rotation of the nozzle head 78 resulting in a spiraling, atomized spray. Shank 88 is also shown.

Figure 11:
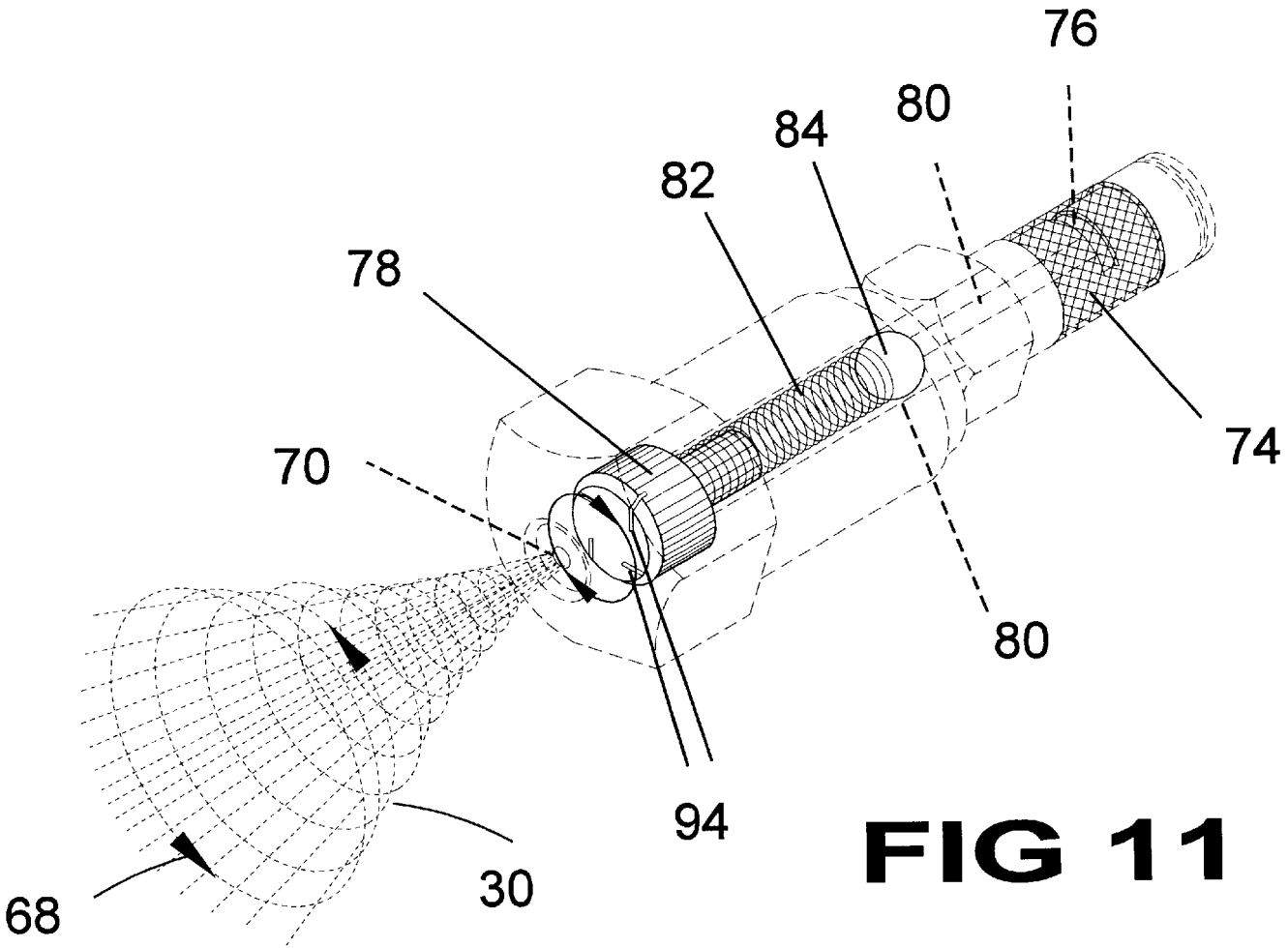
FIG. 11 is a perspective view of a rotational nozzle atomizer with the housing shown in hidden line to illustrate the internal workings of the atomizer during operation.

Turning to FIG. 11, shown therein is a perspective view of a rotational nozzle atomizer with the housing shown in hidden line to illustrate the internal workings of the atomizer during operation. Pressurized fluid enters the atomizer through inlet recess 76 and passes through the central recess or chamber 80 where the fluid is forced through the channels 94 of the nozzle head 78 so that the head 78 rotates the fluid prior to ejection through the outlet aperture 70. Spray 30 is also shown along with other elements previously described.

Figure 12:
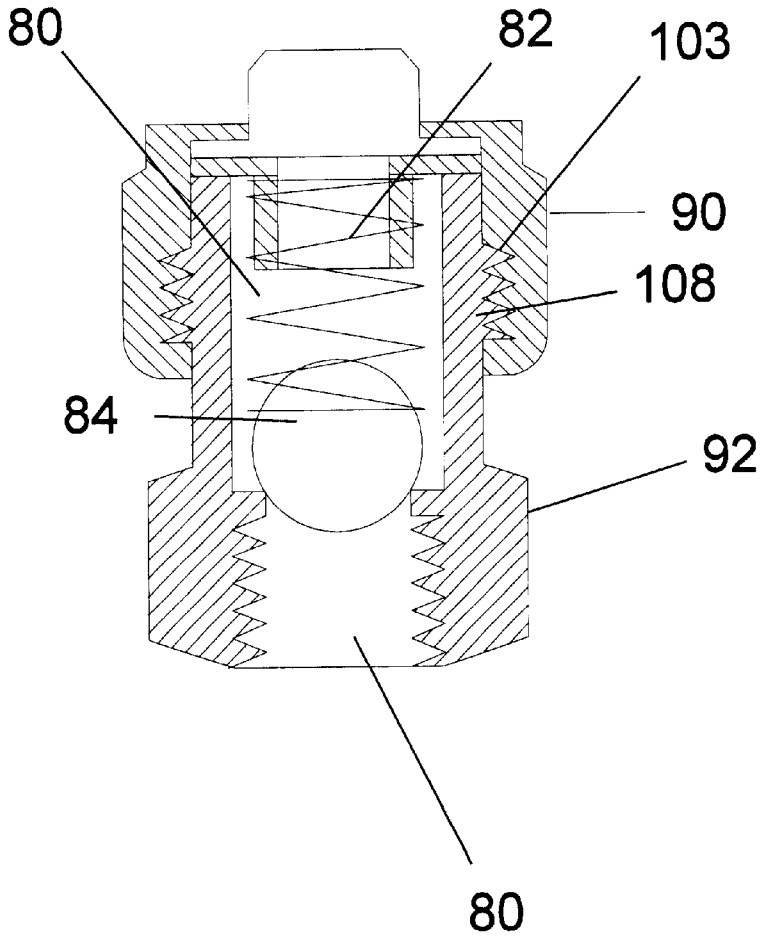
FIG. 12 is a cross-sectional side view of the atomizer assembly showing the check valve assembly.

Turning to FIG. 12, shown therein is a cross-sectional side view of the atomizer assembly showing the check valve assembly. Shown are the housing members 90, 92 along with the inlet conduit or central recess 80, spring 82 and ball 84 of the check valve assembly. The internal threads 103 of housing 90 are shown along with the external threads 108 of housing 92 mating thereto.

What is claimed to be new and desired to be protected by Letters Patent is set forth in the appended claims.

I claim:

1. An apparatus for a fluid atomizer, the atomizer being disposed on a fluid conduit, the fluid conduit having at least one female threaded opening thereon for receiving the mating threads of the atomizer, comprising:

a) a first cylindrical housing through which fluid flows having a first end and a second end, said first end being open, said second end being closed, said housing having a central conduit therein, said central conduit connecting said first end and said second end, said second end having an outlet aperture centrally disposed therein for the fluid to exit;

b) a second cylindrical housing through which fluid flows having a first end and a second end, said first end being open, said second end being closed, said housing having a central conduit therein, said central conduit connecting said first end and said second end, said second end having an inlet aperture disposed adjacent thereto for the fluid to enter;

c) means for rotating the fluid disposed adjacent said outlet aperture whereby the fluid rotates as the fluid exits said outlet aperture;

d) means for controlling the fluid flow as the fluid passes through said central conduit of said first housing and said second housing;

e) a first means for connecting said first housing and said second housing to each other; and, f) a second means for connecting said first housing and said second housing to the fluid conduit.

2. The apparatus of claim 1, wherein said first means for connecting said first housing and said second housing to each other further comprises said first end of said first housing having threads disposed internally thereon.

3. The apparatus of claim 1, wherein said first means for connecting said first housing and said second housing to each other further comprises said first end of said second housing having threads disposed externally thereon, said external threads of said second housing mating to said internal threads of said first housing.

4. The apparatus of claim 3, wherein said second means for connecting said first housing and said second housing to the fluid conduit further comprises said first end of said first housing having threads disposed externally thereon for mating to the female threaded opening of the fluid conduit.

5. The apparatus of claim 4, wherein said second end of said first housing has a head portion thereon for receiving a wrench whereby said first housing can be tightened into the fluid conduit.

6. The apparatus of claim 5, wherein said second housing has a head portion thereon intermediately disposed between said first end and said second end, said head portion for receiving a wrench whereby said second housing can be tightened into said first housing.

7. The apparatus of claim 1, further comprising a filter screen disposed over said inlet aperture for filtering the entering fluid.

8. The apparatus of claim 6, wherein said means for rotating the fluid further comprises a rotatable nozzle head disposed adjacent said outlet aperture, said nozzle head having an enlarged head end and a shank end, said head end disposed adjacent said outlet aperture, said head having a diameter slightly less than the diameter of said central conduit of said first housing.

9. The apparatus of claim 8, further comprising means for multiple fluid channels disposed on the periphery of said nozzle head whereby said head rotates as fluid passes through said central conduit of said first housing.

10. The apparatus of claim 9, wherein said means for multiple channels further comprise multiple channels disposed diagonally along the periphery of said nozzle head, said channels providing a passageway for fluid to flow between said nozzle head and said first housing.

11. The apparatus of claim 10, wherein said means for controlling the fluid flow through said central conduit further comprises means for a check valve assembly.

12. The apparatus of claim 11, wherein said means for a check valve assembly further comprises a spring.

13. The apparatus of claim 12, wherein said means for a check valve assembly further comprises a ball.

14. The apparatus of claim 13, wherein said spring is disposed longitudinally internal said central conduit, said spring having a first end and a second end, said spring having a diameter slightly greater than the diameter of said shank end of said head, said first end of said spring for receiving the insertion of said shank.

15. The apparatus of claim 14, wherein said ball has a slightly greater diameter than said central conduit of said second housing, said ball disposed between said second end of said spring and said first end of said second housing, said ball being thereby biased against said central conduit of said second housing thereby metering the flow of fluid from said second housing to said first housing.

* * * * *